US007610856B2

(12) United States Patent
Stark et al.

(10) Patent No.: US 7,610,856 B2
(45) Date of Patent: Nov. 3, 2009

(54) CASELESS, COMPLETE ROUND AND ALSO A METHOD OF MANUFACTURING SUCH A CASELESS, COMPLETE ROUND

(75) Inventors: Ola Stark, Karlskoga (SE); Lennart Gustavsson, Karlskoga (SE)

(73) Assignee: Bofors Defence AB, Karlskoga (SE)

( * ) Notice: Subject to any disclaimer, the term of this patent is extended or adjusted under 35 U.S.C. 154(b) by 399 days.

(21) Appl. No.: 10/524,054

(22) PCT Filed: Aug. 7, 2003

(86) PCT No.: PCT/SE03/01254

§ 371 (c)(1),
(2), (4) Date: Oct. 5, 2005

(87) PCT Pub. No.: WO2004/015358

PCT Pub. Date: Feb. 19, 2004

(65) Prior Publication Data

US 2006/0096485 A1 May 11, 2006

(30) Foreign Application Priority Data

Aug. 8, 2002 (SE) ..... 0202388

(51) Int. Cl.
*F42B 5/196* (2006.01)

(52) U.S. Cl. ..... 102/431

(58) Field of Classification Search ..... 102/431, 102/432, 433

See application file for complete search history.

(56) References Cited

U.S. PATENT DOCUMENTS

| | | | | |
|---|---|---|---|---|
| 3,688,697 | A | 9/1972 | Paul et al. | |
| 3,726,222 | A * | 4/1973 | White et al. | 102/431 |
| 3,734,020 | A * | 5/1973 | Ciccone et al. | 102/443 |
| 3,977,324 | A * | 8/1976 | Stevenson et al. | 102/442 |
| 4,063,486 | A * | 12/1977 | Ashley | 89/7 |
| 4,126,078 | A * | 11/1978 | Ashley | 89/7 |
| 4,282,670 | A * | 8/1981 | Junker | 42/16 |
| 4,709,636 | A | 12/1987 | Mueller et al. | |
| 5,133,240 | A | 7/1992 | Thiesen et al. | |
| 6,123,007 | A * | 9/2000 | O'Dwyer | 89/135 |
| 6,807,908 | B2 * | 10/2004 | Brydges-Price | 102/512 |

FOREIGN PATENT DOCUMENTS

| | | |
|---|---|---|
| DE | 3927400 | 2/1991 |
| DE | 19741839 | 3/1999 |
| DE | 19741842 | 3/1999 |

OTHER PUBLICATIONS

International Search Report No. PCT/SE2003/001254, dated Oct. 14, 2003, 3 pgs.

* cited by examiner

*Primary Examiner*—Troy Chambers
(74) *Attorney, Agent, or Firm*—Connolly Bove Lodge & Hutz LLP

(57) ABSTRACT

The invention also relates to a method of manufacturing and use of the ammunition round in other more conventional weapon systems than the said electrothermal and/or electro-thermochemical weapon systems.

16 Claims, 1 Drawing Sheet

Figure 1:
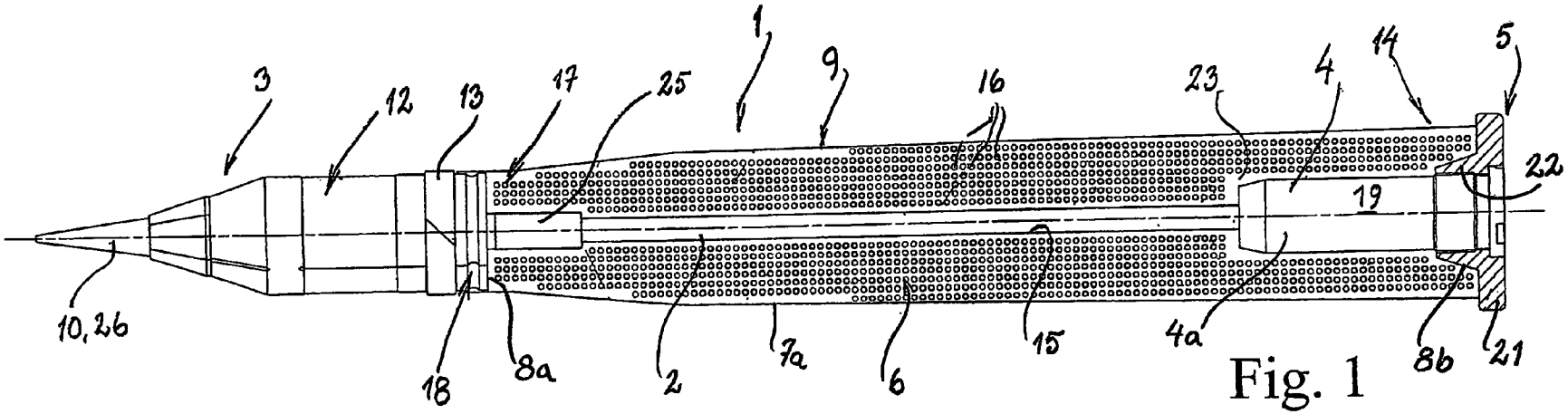

CASELESS, COMPLETE ROUND AND ALSO A METHOD OF MANUFACTURING SUCH A CASELESS, COMPLETE ROUND

TECHNICAL FIELD

The present invention relates to a complete ammunition round intended to be loaded as a coherent unit primarily in electrothermal and/or electrothermochemical weapon systems, which round comprises a propellent charge for propulsion of a projectile through a barrel and which projectile is arranged on the front end of the propellent charge, a bottom piece which is arranged on the rear end of the propellent charge, and a firing device arranged, preferably detachably, on the bottom piece.

The invention also relates to a method of manufacturing a caseless, complete ammunition round which is loaded as a coherent unit primarily in electrothermal and/or electrothermochemical weapon systems, which round comprises a propellent charge which propels a projectile through a barrel and which projectile is arranged on the front end of the propellent charge, a bottom piece which is arranged on the rear end of the propellent charge, and a firing device arranged, preferably detachably, on the bottom piece, the component parts of the projectile part being assembled in a conventional manner.

The invention relates furthermore to use of the ammunition round in other more conventional weapon systems than the said electrothermal and/or electrothermochemical weapon systems, but preferably in electrothermal and/or electrothermochemical weapon systems.

PROBLEMS AND BACKGROUND OF THE INVENTION

In electrothermochemical (ETC) cannons, use is made of electrical energy from a high-voltage source in order to bring about ignition of the propellent charge, and then of on the one hand chemical energy from the combustion of this propellent charge and on the other hand electrical energy in the form of one or more pulses in order to supply more energy to the propellent gas in the form of plasma formation from the latter or via the creation of an electric potential difference along the barrel in order to increase the speed of the projectile.

For ETC cannons, there is a specific risk of the cartridge case burning on in the barrel owing to electric short-circuiting between the cartridge case and the barrel. This is because the modern conventional cartridge case is manufactured from electrically conductive metal, usually brass. The burning-on is caused by the current and/or the voltage used during firing being intentionally or unintentionally conducted across to the cannon/artillery piece via the barrel. Moreover, the fact that the cannon/artillery piece becomes live constitutes an extra disadvantage for the gun crew.

Another general problem with all conventional ammunition, that is to say ammunition comprising cartridge cases which are essentially made entirely of metal, is the relatively considerable weight of such cases. One way of reducing the weight is to replace the case metal, at least partly, with a lighter material, which material is then normally either combustible or otherwise non-resistant. A serious consequential problem which arises because of the said lightweight ammunition is that, when combustion of the case concerned takes place, undesirable residual products are always formed, which are deposited on or otherwise impact negatively on the inside of the barrel, for example increase the risk of corrosion, reduce service life etc.

In order to reduce the quantity of residual products, it is therefore desirable to manufacture the lightweight ammunition with as thin a case as possible. There is then a risk that the case will not be sufficiently dimensionally stable, but will be torn to pieces or melt in connection with firing. When this happens, the lightweight cases cannot be removed from the barrel of the weapon concerned in a sufficiently simple manner. And if the lightweight ammunition is instead made with a certain minimum jacket thickness determined by the risk of the case bursting, the abovementioned problems of undesirable residual products then arise instead.

Another problem with these known lightweight rounds is that, on account of the excessively thin case jacket, they have unsatisfactory rigidity and strength with regard to storage and handling of the rounds. Moreover, if the combustible material consists of water-absorbing material such as cardboard, there are problems associated with moisture-protection in bad weather and with durability over time.

Furthermore, the combustible lightweight cases known today, in which attempts have been made to remedy the problems caused by inadequate dimensional stability, rigidity, strength and durability and also the residual products formed, comprise many different, and often expensive, small parts which are assembled in altogether too many part-stages. These cases are therefore very complicated to manufacture and therefore expensive as well.

Various versions of arrangements of the type indicated above are known.

PRIOR ART

Patent specification EP-A2-0 149 718 describes a combustible propellent charge case which is intended in particular for fixed large-calibre ammunition. In order to simplify the manufacture of the ammunition and to improve its storage capacity, the cartridge case is made from a synthetic material. The ammunition described is stated to achieve particularly advantageous mechanical properties and stability if the case is made from shrink-film material. The round is entirely without stability-increasing elements other than the case used, and as the propellent charge, which at the most is arranged in separate powder bags, is stated to be a loose powder which is stabilized only by being compressed slightly during actual filling of the case, via the contracting action of the shrink film or via evacuation of the air enclosed in the case, it is clear that the robustness of the round is virtually entirely dependent on the thickness of and material selected for the case.

It goes without saying that such a case has a clearly limited possible length in relation to the diameter of the round and the thickness of the case because an elongate round with a thin case is easily broken by its own weight or the weight of the projectile. Moreover, it is likely that the case material has to be designed with extra oxygen-emitting component parts in order that a large quantity of residual material will not remain in the barrel after firing, which is also suggested in the said patent specification.

From DE-39 27 400-A1, a combustible propellent charge case or container is also known, which is claimed in itself to have sufficient dimensional stability in order to bring about fixing of the powder, which is loose in the case from the outset, without additional elements for stiffening and holding together being arranged in the case for handling of the round. This case as well therefore has such a thick jacket and thus such a total mass that it is absolutely essential that the case is made from a special oxygen-emitting material in order that the case will not be burnt on in the barrel in connection with firing of the round.

In an embodiment shown especially, use is also made of the projectile itself, which is then entirely enclosed by the case and the propellent charge, as an element for stiffening and holding together. It is clear that, if the round is placed upside down during handling, the projectile will make a hole in the casing, which renders the round unfit for use. A large proportion of the propellent charge is moreover located alongside the projectile, as a result of which, in the event of incorrect ignition of the propellent charge of the round, a partly opposite or even negative direction of the propulsion gases may arise, so that bursting of the barrel or the breech of the cannon may occur.

U.S. Pat. No. 5,183,961 describes a very complicated method and arrangement for attempting to reduce this considerable risk of bursting of the barrel in the event of incorrect ignition of a front propellent charge located alongside the projectile. In order to attempt to bring about correctly timed ignition, there is a large number of ignition strand tubes, holders, spacers and other elements mounted between the fuse of the round and the charge.

A considerable problem with the construction shown is that the entire inner, extremely complex arrangement of ignition strand tubes, holders, spacers etc. including the rigid case has to be assembled before the loose powder is poured into the case via a filling hole arranged specially for the purpose in the bottom piece of the round. In order to hold the projectile in place during filling of the powder grains and in order to allow only axial position-changing when the projectile is fired, a fin support shaft is mounted inside the case. The function is accordingly stated to be not for improving the robustness of the round for handling etc. but for centring the projectile when the propellent charge has as yet not been introduced or is being filled and also for guiding the projectile when firing takes place. A case with great dimensional stability and a considerable quantity of material is still required for enclosing the powder and stiffening the round. The manufacturing time and cost for this very complicated construction are therefore considerable. All these extra elements moreover constitute additional component parts which form disadvantageous residual products when firing takes place.

The main technical problems which form the basis of the present invention have consequently been the excessive weight of the conventional case, the inadequate rigidity and strength of the lightweight cases, the negative effects of the inevitable residual products and also the number of extra component parts which have to be added in order to obtain a desired ignition process, and a desire to produce a caseless round in which no loads have to be taken up by a case.

OBJECTS AND FEATURES OF THE INVENTION

A main object of the present invention is to produce a new type of complete ammunition round primarily, but not exclusively, for electrothermochemical weapon systems, which ammunition round is constructed in such a way that it considerably reduces or completely eliminates all the abovementioned problems and then in particular the need for an essentially dimensionally stable and/or load-bearing case for normal storage, handling and use of the round, the risk of a cartridge case burning on and also other negative effects resulting from combustion residues of a case in the barrel and chamber.

Another object of the present invention is to produce a round which is considerably improved with regard to the said manufacture-related and economic aspects but which nevertheless has superior strength and robustness compared with corresponding known combustible rounds, it being possible to utilize the favourable effects of this type of ammunition in a better way than previously for most weapon types and calibres in which conventional fixed ammunition is normally used today.

The said objects, and other aims not listed here, are achieved within the scope of what is stated in the present independent patent claims. Embodiments of the invention are indicated in the dependent patent claims.

According to the present invention, therefore, a considerably improved complete ammunition round has been produced, which is characterized in that the round is caseless and comprises an elongate inner component for stiffening and holding together, which inner component is arranged on or in close proximity to the rear end of the projectile and mounted, preferably detachably, on the firing device through a central through-hole arranged in the propellent charge, in that the propellent charge consists of a load-absorbing, essentially completely combustible, externally cartridge-shaped, dimensionally stable block powder charge which has such rigidity and strength and which propellent charge is otherwise arranged in such a way, preferably attached to or at least arranged essentially adjacent to the projectile, the inner component, the firing device and the bottom piece, that, in heavier ammunition as well, a considerable proportion of the loads which are detrimental to the functioning of the round and can occur during normal storage, handling and use of the round is taken up only via the propellent charge and the inner component, and which block powder charge comprises an, at least external, insulating surface, coating and/or application which is nevertheless of insufficient rigidity and robustness to bear the abovementioned loads.

According to other aspects of the complete, caseless ammunition round according to the invention:

- the inner component constitutes a load-transferring element, for example a rod or tube, anchored firmly between the projectile and the firing device;
- the inner component is made of a combustible material, for example a plastic composite;
- the propellent charge is attached to the component via an adhesive connection;
- the propellent charge is arranged so as to engage in at least a rear part of the projectile and/or a front part of the bottom piece;
- the propellent charge consists of a multi-perforated, progressive block powder;
- the propellent charge comprises a plurality of part elements which are joined together by means of a suitable binder to form a finished, cartridge-shaped propellent charge;
- the insulating surface comprises a non-load-bearing, at least outer, shrink film;
- the insulating coating consists of a non-load-bearing dimeric or polymeric raw material comprising hydrocarbons, such as poly-para-xylylene;
- the application consists of painting or other covering by means of a solution or emulsion;
- the insulating surface, coating or application is moisture-repellent or moisture-proof;
- the insulating surface, coating or application is electrically insulating;
- the insulating surface, coating or application covers all sides of the propellent charge;
- the bottom piece is made of combustible material, suitably a fibre composite;
- the firing device consists of a plasma torch;
- the firing device consists of a fuse.

According to the invention, furthermore, the method for manufacturing the said complete ammunition round is characterized in that:

the inner component is mounted on the projectile part via a connection, the propellent charge is slipped onto the component, after which the bottom piece is applied, and the firing device is attached to the inner component, it being ensured that the propellent charge closely adjoins the bottom piece and the projectile part.

According to other aspects of the method for manufacturing the ammunition round according to the invention:

the inner component is first mounted on the bottom piece via the firing device, then to be guided through the hole of the propellent charge and attached to the projectile part via a front connection;

the propellent charge is applied to an inner rod assembled with other component parts by the propellent charge being divided into at least two sections which are joined at least to one another, but preferably also to the inner component, the projectile, the firing device and/or the bottom piece, via a suitable connection;

the propellent charge is manufactured from a suitably homogeneous, compression-moulded powder block which is subsequently provided with perforations in a predetermined pattern and number in order to bring about the desired progressiveness;

an insulation coating is applied over at least the outer sides and/or inner sides of the propellent charge, via three phases comprising vaporization of a dimeric or polymeric raw material, the polymer or the dimer first being transformed from solid phase to gas phase and then, at a further increased temperature, being transformed to a reactive monomer gas which is made to polymerize on the propellent charge, a thin inner and outer insulating surface layer being deposited on all accessible surfaces;

mounting also comprises a suitable binder being applied between one or more of the component parts making up the round;

the propellent charge is already pre-insulated by means of any one of the said insulations when mounting takes place;

final insulation of the round is effected by coating, painting or other covering or by a thin, non-load-absorbing, moisture-repellent or moisture-proof outer surface or film being applied.

ADVANTAGES AND EFFECTS OF THE INVENTION

By replacing the previously used granulated loose powder with multi-perforated, progressive block powder, it has been possible to produce ammunition with an increased energy content, which has resulted in it being possible to increase the range further in comparison with conventional ammunition. By utilizing the very good inherent robustness of the block powder, it has been possible to connect a block-powder charge to the desired shell projectile and a bottom piece comprising a firing device to form a caseless but nevertheless complete round which can be loaded as a coherent unit.

Moreover, by covering the block-powder charge, and also if appropriate some or all of the other subcomponents necessary or desired for the ammunition type concerned, with a moisture seal in the form of an outer surface, coating or possibly a very thin, completely combustible film, a caseless but nevertheless moisture-proof round has been obtained. Applied liquid, chemical coating, foil, shrink film etc., which can be oxygen-emitting when combustion takes place, may be mentioned as examples of the said outer surface, coating or film. A fuse or a plasma torch and, respectively, sensors or other electronics accompanying the shell, for example, may be mentioned as examples of the firing device and possible other subcomponents.

LIST OF FIGURES

The invention will be described in greater detail below with reference to the accompanying figures in which FIG. 1 is a diagrammatic side view and cross section through parts of a caseless ammunition round according to a first embodiment of the present invention, which round comprises a load-transferring, elongate inner component, for example a rod or a tube, which is mounted between a front projectile shown in the figure and a rear firing device, and also a propellent charge which surrounds the inner component and the firing device and comprises a moisture-proof outer side.

Figure 2:
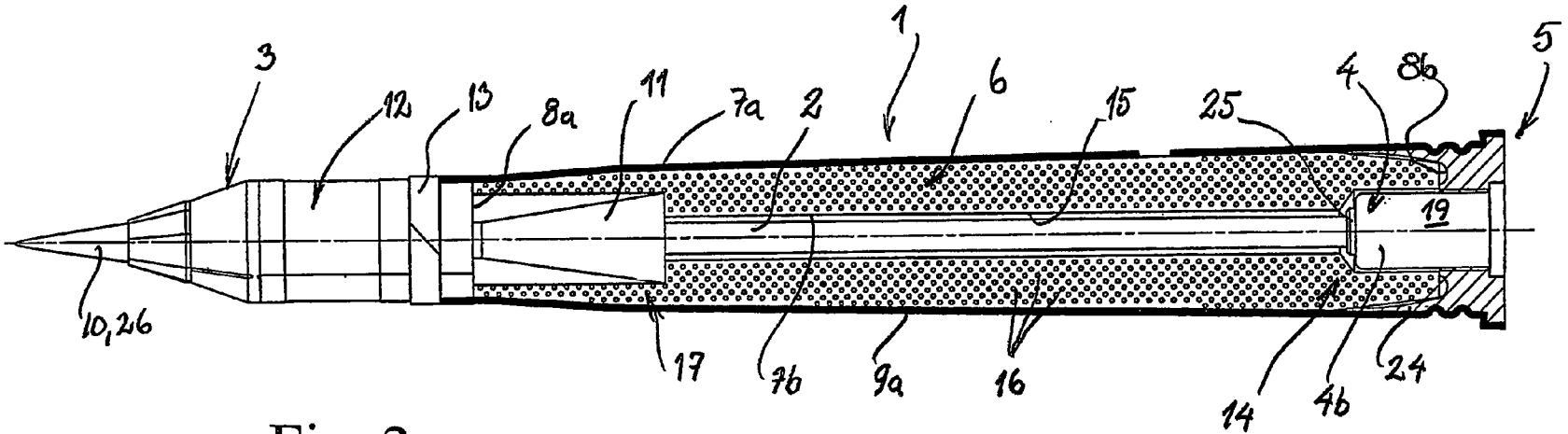

FIG. 2 is a diagrammatic side view and cross section through parts of a caseless ammunition round according to a second embodiment of the present invention, which round comprises a load-absorbing, elongate extension tube for a rear firing device, which tube is mounted between a front projectile shown in the figure and the combustion chamber of the firing device, and also a dimensionally stable block-powder charge which surrounds the inner extension tube, the combustion chamber and a rear part of a projectile and comprises an outer moisture-proof, flexible or contracting surface layer such as shrink film.

DETAILED DESCRIPTION OF EMBODIMENTS

With reference to FIG. 1, a caseless, large-calibre, complete ammunition round 1 according to a first embodiment of the present invention is shown diagrammatically. The round 1 is preferably, but not exclusively, intended for artillery pieces, anti-tank guns and tank cannons. Accordingly, it is entirely possible for the present invention to be used in more small-calibre ammunition as well.

The round 1 comprises a load-transferring and load-absorbing, elongate inner component 2, for example a rod or a tube made of a suitable, preferably combustible, material made of, for example, metal, plastic etc., which is mounted between a front dart projectile 3 shown in the figure and a rear firing device 4 which is screwed detachably into a bottom piece 5 made of, for example, combustible material, suitably a fibre composite. However, the bottom piece 5 can also be metal. The round 1 also comprises a cartridge-shaped propellent charge 6 which is arranged around, that is to say so as to enclose, the said inner component 2. The propellent charge 6, which has an insulated, for example electrically and/or moisture-proof, outer side or outer sides 7*a*, 7*b* (see below) consists of a multi-perforated block-powder charge 6, that is to say a perforated powder which is shaped so as accurately to follow the outer dimensions of the projectile 3, the rod 2 and the bottom piece 5, that is to say the outer sides 8*a*, 8*b* of these facing the propellent charge 6. The propellent charge 6 has such rigidity and strength that, in heavier ammunition as well, a considerable proportion of the loads which can occur during normal storage, handling and use of the round 1 is taken up only via the propellent charge 6.

According to the invention, the outer side or outer sides 7*a*, 7*b* of the propellent charge 6, that is to say those sides 7*b* also of the propellent charge 6 facing the inner component 2, the projectile 3, the firing device 4 and the bottom piece 5, comprise only an insulation 9, for example a moisture-proof coating, which is of insufficient rigidity and robustness to bear the loads which might be expected to occur during storage, handling or use of the round 1. The round 1 is therefore caseless, that is to say the round 1 entirely lacks any load-absorbing outer enclosure of the parts between the projectile 3 of the round and its bottom piece 5. The moisture seal 9 suitably consists of an outer coating in the form of a dimeric or polymeric raw material comprising hydrocarbons, such as poly-para-xylylene, also known as Parylene, which is applied by phase transformation, such as vaporization and condensation to form an insulating film, painting or other covering by means of a suitable solution or emulsion etc. However, the insulation 9 can also be applied to the outer side or outer sides 7*a*, 7*b* of the propellent charge 6 in the form of a thin, non-load-absorbing, moisture-repellent or moisture-proof outer surface or film 9*a*, for example a plastic foil, shrink film etc. (see FIG. 2 in particular). Such a film 9*a* can also be electrically insulating.

The firing device 4, which has a length which is adapted according to what is desirable in the round 1 concerned, that is to say it can be either longer or shorter, which is compensated by the length of the inner rod 2, can consist of either a plasma torch 4*a* (see FIG. 1) or a fuse 4*b* (see FIG. 2) depending on the firing method, that is to say electric or conventional respectively, used by the weapon system concerned.

In the embodiments of the round 1 shown in the figures, the projectile 3 comprises an armour-piercing dart 10, the guide fins or guide cone 11 of which armour dart 10 (see FIG. 2 in particular) are or is at least partly enclosed in and supported inside the propellent charge 6. The projectile 3 also comprises a multi-part dart support body 12. Arranged around the body 12 is a belt 13, preferably made of plastic, for sealing the round 1 in relation to the inside of the barrel.

The propellent charge 6, which has an essentially cylindrical cartridge shape, determined according to the ammunition 1 of the weapon type concerned, with regard to longitudinal and transverse section, calibre and length, also comprises a central through-hole 15 which extends between the front end 17 and the rear end 14 of the propellent charge 6. The geometry of the hole is adapted in such a way that it surrounds with the maximum possible fit and adjoins firstly the elongate inner component 2, which is mounted inside the through-hole 15 of the propellent charge 6 between the projectile 3 and the firing device 4, secondly the rear end 18 of the projectile 3 and/or the guide component 11 which may be located there (see FIG. 2) and thirdly the firing device 4 concerned. The front end 17 and/or the rear end 14 of the propellent charge 6 can then be designed so as either to engage in or to surround those sides 8*a*, 8*b* of the projectile 3 and, respectively, the bottom piece 5 facing the propellent charge 6. The length of the elongate inner component 2 varies according to the distance between the projectile 3 and the firing device 4 projecting from the bottom piece 5 and can therefore extend over a greater or lesser part of the length of the round 1 depending on the length of the combustion chamber 19 of the firing device 4 and the guide component 11.

The inner component 2 can consist of an expansion tube for the powder gases or the plasma, which tube 2 comprises connections 25, suitably threaded connections, which hold the round 1 together until firing takes place and the combustion gases then formed cause the projectile 3 to accelerate out of the barrel. During combustion of the propellent charge 6, which is suitably progressive via the multi-perforation 16, the tube 2 functions as a distributor of the ignition process via a front opening and/or preferably a plurality of openings along its length, in which way the ignition from the firing device 4 is transmitted in a predetermined way. While the caseless propellent charge 6 is completely gasified, the inner component 2 is suitably also combusted completely or partly depending on the material selected, or else the connections 25 are arranged in such a way that either the component 2 accompanies the projectile 3 out of the barrel until the active part 26 of the projectile 3 is released from other projectile parts such as the dart support body 12 etc. or the component 2 comes out together with any remaining parts of the bottom piece 5 and the firing device 4. These are removed easily in connection with the breech of the weapon being opened for introduction of a new round 1, and so the ammunition round 1 described can also be used for automatic fire.

It will be understood that the round 1 shown is not only intended for such ETC ammunition and that it can also include several different sizes and projectile types depending on the area of use and calibre. Here, however, it is at least the commonest ammunition types today, between roughly 25 mm and 160 mm, which are concerned.

In the embodiments according to the figures, a separate bottom piece 5, which can be either electrically conductive or non-conductive, and is suitably made of metal material or, respectively, of glass-fibre epoxy, is also arranged on the rear end 14 of the propellent charge 6 in a tight-fitting way by means of adhesive bonding or another connection suitable for the function. In the embodiment according to FIG. 1, the bottom piece 5 has an outer peripheral flange part 21 for sealing in relation to the chamber and a central part 22 which is suitably threaded for the firing device 4 and is arranged so as to engage in a somewhat wider outer part 23 of the through-hole 15 in the propellent charge 6 (compare FIG. 2 where the round 1 instead comprises a bottom piece 5 which surrounds the fuse 4*b* and the rear end 14 of the propellent charge 6 with an edge 24 which tapers towards the propellent charge 6).

The propellent charge 6 is preferably manufactured in one piece, that is to say as an element. However, it is possible, in embodiments which are not shown, for the propellent charge 6 to be divided, suitably in its transverse and/or longitudinal direction, into two or more part sections which, when joined together, form the desirable, suitably cartridge-shaped, shape of the propellent charge 6.

DESCRIPTION OF FUNCTION

The method for application of an insulation 9 in the form of a coating of the dimeric or polymeric raw material type via phase transformation (see above) is as follows.

The insulation coating 9 is applied over at least the outer sides and/or inner sides 7*a*, 7*b* of the propellent charge, but can of course also be applied over all those surfaces of the other component parts of the round 1 which are external when application takes place, via three phases comprising vaporization of a dimeric or polymeric raw material comprising hydrocarbons (plastic), such as poly-para-xylylene, the polymer or the dimer first, at roughly 150° C., being transformed from solid phase to gas phase and then, at a further increased temperature of roughly 650° C., being transformed to a reactive monomer gas which is finally made to condense (that is to say polymerize) on the propellent charge 6 etc. which is suitably at room temperature and under vacuum, a thin inner and outer insulating surface layer being deposited on all the free surfaces of the round 1 with a thickness of roughly 20-70μ.

The resulting highly pure, hole-free, tough and elastic polymer surface 9 is completely smooth and has a low friction coefficient (as a result of which the cartridge case is provided with spontaneous lubrication), high abrasion-resistance, low water absorption, and also a high dielectric constant of roughly 200 V/μm. Moreover, the polymer surface is non-sensitive to gases, solvents, chemicals, water and moisture.

When a bottom piece 5 made of glass-fibre epoxy is used, turning-out of the bottom piece 5 takes place after shaping and hardening have been completed, attention being paid to obtaining the correct interference fit to the rear end 14 of the propellent charge 6 concerned.

The abovementioned rigidity and strength of the propellent charge 6 are obtained by the charge 6 being manufactured from a suitably homogeneous, compression-moulded powder block which is subsequently provided with perforations 16 in a predetermined pattern and number in order to bring about the desired progressiveness. It is also conceivable for the propellent charge body 6 itself to comprise a plurality of part elements (not shown) which are joined together by means of a suitable binder to form a finished, cartridge-shaped propellent charge. Owing to the rigidity and strength of the propellent charge 6, it is entirely possible within certain ammunition sizes for the propellent charge 6 alone to take up all the loads which normally occur.

The method for joining the round 1 according to the invention together is as follows.

The component parts of the projectile part 3 are assembled in a conventional manner, after which the inner component 2 is mounted on the projectile part 3 via the connection 25. The propellent charge 6 is slipped onto the component 2 via the central hole 15, after which the bottom piece 5 is applied. The firing device 4 is then attached to the inner component 2, suitably via a screw connection, it being ensured that the propellent charge 6 closely adjoins the bottom piece 5 and the projectile part 3, after which the assembly of the round 1 is complete. The mounting described can also comprise a suitable binder being applied between one or more of the said component parts. If appropriate, final insulation 9 of the round 1 takes place according to the dimeric or polymeric film coating, painting or other covering described above, or else a thin, non-load-absorbing, moisture-repellent or moisture-proof outer surface or film 9*a*, for example a plastic foil, shrink film etc. can be applied. However, the propellent charge 6 can already be pre-insulated by means of any one of the said insulations 9 when mounting takes place.

Alternatively, the inner component 2 can first be mounted on the bottom piece 5 via the firing device 4, then to be guided through the hole 15 of the propellent charge 6 and attached to the projectile part 3 via the front connection 25.

Finally, it is also within the inventive idea for the propellent charge 6 to be applied to an inner rod 2 assembled with other component parts by the propellent charge 6 being divided into at least two sections which are joined at least to one another, but preferably also to the inner component 2, the projectile 3, the firing device 4 and/or the bottom piece 5, via a suitable connection, preferably adhesively bonded, after which insulation 9 takes place via coating, covering and/or via shrink film etc.

ALTERNATIVE EMBODIMENTS

The invention is not limited to the embodiment shown but can be varied in different ways within the scope of the patent claims. It is clear, for example, that an insulating coating and protective layer can also be obtained by means of conventional varnishing of the round and the propellent charge. Compared with the polymer vaporization described above, however, varnishing has disadvantages such as, for example, higher permeability and worse adhesion, and the varnish can also crack. It is clear, for example, that although the round described above is in the first instance intended for artillery pieces, the method and the round according to the present invention comprise all weapon types and ammunition where ammunition rounds are used.

The insulating protective layer can consist of, for example, a combustible synthetic shrink film which can advantageously be of the type which, when combustion takes place, emits at least some of the oxygen necessary for the combustion or another advantageous material or substance with, for example, a friction-reducing, lubricating or corrosion-preventing function.

The invention claimed is:

1. A complete ammunition round intended to be loaded as a coherent unit, the complete ammunition round comprising:

a block powder propellant charge comprising a projectile arranged on a front end thereof and a bottom piece arranged on a rear end thereof, wherein the block powder propellant charge is for propulsion of the projectile through a barrel;

a firing device arranged on the bottom piece of the block powder propellant charge;

an elongate inner component arranged on or in close proximity to the projectile and mounted on the firing device through the block powder propellant charge, wherein the block powder propellant charge is a load-absorbing propellant charge, and wherein the block power charge and the elongate inner component have sufficient rigidity for bearing a load; and an external, insulating surface, coating and/or application which is of insufficient rigidity to bear the load;

wherein the complete ammunition round is caseless.

2. The complete ammunition round according to claim 1, wherein the elongate inner component comprises a load-transferring element anchored firmly between the projectile and the firing device.

3. The complete ammunition round as claimed in claim 1, wherein the elongate inner component comprises a combustible material.

4. The complete ammunition round according to claim 1, wherein the block power propellant charge is attached to the elongate inner component via an adhesive connection.

5. The complete ammunition round according to claim 1, wherein the block powder propellant charge is arranged so as to engage in at least a rear part of the projectile and/or a front part of the bottom piece.

6. The complete ammunition round according to claim 1, wherein the block powder propellant charge comprises a multi-perforated progressive block powder.

7. The complete ammunition round according to claim 1, wherein the block powder propellant charge comprises a plurality of part elements which are joined together by means of a binder to form a finished, cartridge-shaped block powder propellant charge.

8. The complete ammunition round according to claim 1, wherein the insulating surface comprises a non-load-bearing, at least outer, shrink film.

9. The complete ammunition round according to claim 1, wherein the insulating coating comprises a non-load-bearing dimeric or polymeric raw material comprising hydrocarbons.

10. The complete ammunition round according to claim 1, wherein the application comprises painting or other covering by means of a solution or emulsion.

11. The complete ammunition round according to claim 1, wherein the external, insulating surface, coating and/or application is moisture-repellent or moisture-proof.

12. The complete ammunition round according to claim 1, wherein the external, insulating surface, coating and/or application is electrically insulating.

13. The complete ammunition round according to claim 1, wherein the external, insulating surface, coating and/or application covers all sides of the propellant charge.

14. The complete ammunition round according to claim 1, wherein the bottom piece is made a combustible material.

15. The complete ammunition round according to claim 1, wherein the firing device comprises a plasma torch.

16. The complete ammunition round according to claim 1, wherein the firing device comprises a fuse.

* * * * *